United States Patent [19]

Fantou

[11] Patent Number: 4,543,552

[45] Date of Patent: Sep. 24, 1985

[54] TRANSFORMER, MORE ESPECIALLY A VOLTAGE DROPPING TRANSFORMER FOR AN ELECTRIC WELDING MACHINE

[75] Inventor: Jean-Paul Fantou, Chateau du Loir, France

[73] Assignee: ARO, Chilly Mazarin, France

[21] Appl. No.: 502,235

[22] Filed: Jun. 8, 1983

[30] Foreign Application Priority Data

Jun. 8, 1982 [FR] France ..... 82 09967

[51] Int. Cl.[4] ..... H01F 27/10

[52] U.S. Cl. ..... 336/60; 336/62

[58] Field of Search ..... 336/57, 58, 60, 61, 336/62; 219/86.31, 116

[56] References Cited

U.S. PATENT DOCUMENTS

| | | | |
|---|---|---|---|
| 1,394,044 | 10/1921 | Stephens | 336/62 X |
| 2,577,825 | 12/1951 | Strickland, Jr. . | |
| 2,579,522 | 12/1951 | Strickland, Jr. . | |
| 2,770,785 | 11/1956 | Haagens et al. . | |
| 3,137,830 | 6/1964 | Emaus, Jr. et al. . | |
| 4,039,990 | 8/1977 | Philp | 336/60 |
| 4,156,221 | 5/1979 | Graul | 336/60 X |

FOREIGN PATENT DOCUMENTS

| | | | |
|---|---|---|---|
| 686380 | 1/1940 | Fed. Rep. of Germany | 336/60 |
| 1130780 | 2/1957 | France . | |
| 1488462 | 6/1967 | France . | |
| 1513090 | 1/1968 | France | 336/62 |
| 368541 | 4/1963 | Switzerland | 336/62 |
| 284774 | 3/1928 | United Kingdom . | |
| 812162 | 4/1959 | United Kingdom . | |

OTHER PUBLICATIONS

French Certificate of Addition No. 2,085,609.

*Primary Examiner*—Reinhard J. Eisenzopf
*Attorney, Agent, or Firm*—Larson and Taylor

[57] ABSTRACT

A voltage dropping transformer for an electric welding machine, of the type in which the secondary circuit is formed by a wound strip, is provided wherein one or more cooling turns are incorporated or inserted in the windings of the primary and/or secondary circuits, separating them into several parts while being in thermal contact therewith. The turns are electrically inactive—having solely a cooling role—and do not form part of the electric circuits of the windings.

10 Claims, 5 Drawing Figures

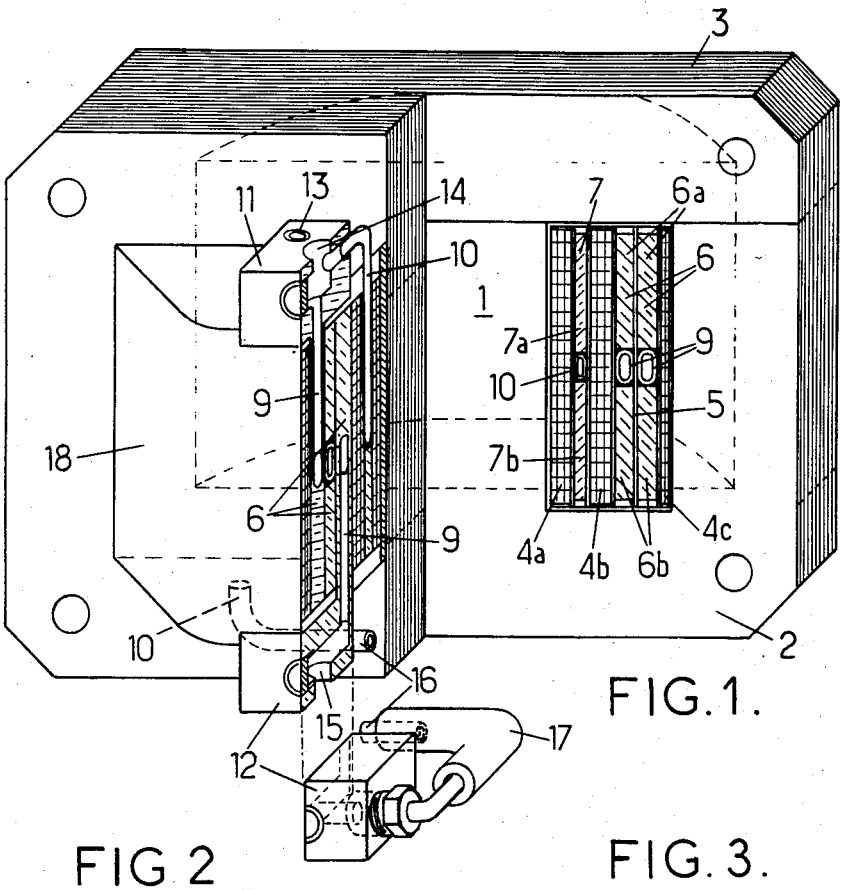
FIG. 1.
FIG 2
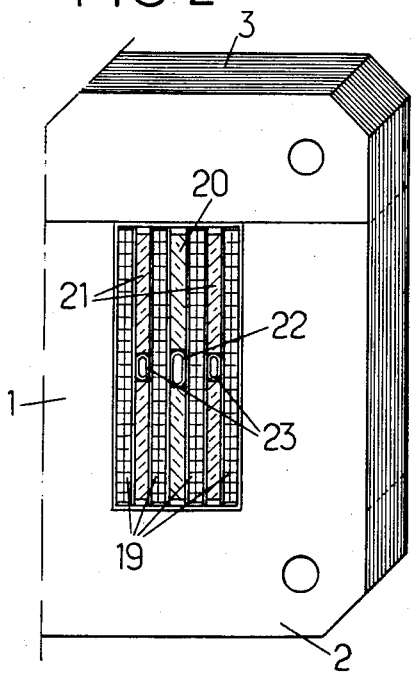
FIG. 3.
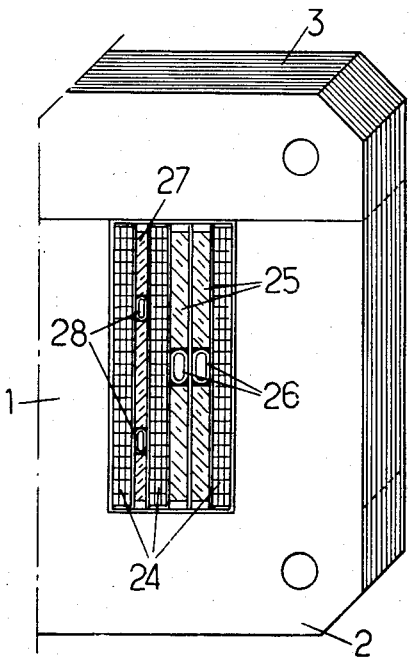

TRANSFORMER, MORE ESPECIALLY A VOLTAGE DROPPING TRANSFORMER FOR AN ELECTRIC WELDING MACHINE

FIELD OF INVENTION

The present invention relates to a transformer and, more particularly a voltage dropping transformer, the secondary circuit of such a transformer, of the type formed by a wound strip, having as a rule currents of high intensity flowing therethrough. As is known, transformers of this type are widely used in electric welding machines, more especially portable spot welding machines, known under the name of welding pliers or tongs, whose secondary, through which very high currents on the order of a few thousand amps, flow supplies welding electrodes.

The invention relates more especially to the system for cooling such transformers and in particular for cooling the windings, i.e. essentially the electric circuit.

BACKGROUND OF THE INVENTION

The applicant has already proposed in the past a solution for considerably increasing the efficiency of the cooling system, this solution consisting briefly in cooling not only the secondary circuit of the transformer but also its primary circuit, by dividing it into several separate parts or sections by means of one or more turns of the secondary circuit, themselves directly cooled by an appropriate cooling circuit and in thermal contact with said parts of the primary circuit; in other words, this older solution consisted in incorporating one or more cooled turns of the secondary winding of the transformer in the winding of the primary, to cool this latter also.

As for the cooling circuit, it was formed for example as a duct through which a cooling fluid flows, and it was incorporated, for example by being brazed, between two juxtaposed parts of the copper and possibly aluminium strip, wound about the core and forming the turn(s) of the secondary circuit, and this according to any appropriate technological procedure.

This solution has proved satisfactory in numerous cases, but progress in the technique, more especially in the field of high-speed automatic welding by robots, has shown the limits thereof and has made it necessary to improve it again so as to further increase the cooling efficiency, while maintaining, which is particularly indispensable in this precise case of use, the option of being able to use space-saving, high efficiency transformers whose weights are as reduced as much as possible, so as not to reduce the intrinsic performances of the robots.

Now, one cannot hope to exceed a certain degree of cooling by simply extrapolating the older solution which has just been described and by dividing the winding of the primary into a larger number of parts or sections, for that would automatically lead to increasing also the number of cooling turns of the secondary circuit required for separating these sections, which is impossible, this number being itself imposed by the transformation ratio, for a given number of turns of the primary.

SUMMARY OF THE INVENTION

The aim of the present invention is to resolve this problem and, for this purpose, a transformer in accordance with the invention, particularly a voltage dropping transformer for an electric welding machine, is essentially characterized in that it comprises one or more cooling turns inside which a cooling fluid flows, these turns being incorporated or inserted in the primary and/or secondary windings and separating them into several parts while being in thermal contact with them, this turn(s) being electrically inactive—having solely a cooling role—and not forming part of the electric circuits of said windings.

Thus, with the invention, the number of sections or parts into which the primary winding (if necessary secondary winding) of the transformer is divided may be increased as much as desirable, two adjacent sections being separated each time by a cooling turn, since the multiplication of the inactive cooling turns, (not forming part of the electric circuit) causes no modification of the transformation ratio. Thus, it can be seen that the invention further increases considerably the efficiency of cooling of the transformer, in particular of the whole of its primary winding, while making this cooling more homogeneous than in the past, which avoids the risk of appearance of hot spots.

As can be seen from the preceding, the invention, by its general design, in no wise presumes on the way in which the secondary circuit may be formed, but it is certain, especially in the case of dropping transformers for welding machines with a very high current flowing in the secondary, that it will be quite advantageous to form it essentially in the same way as in the past, namely in the form of one or more active turns (i.e. forming precisely the secondary circuit) wound about the core and also cooled, these active turns having then a construction similar to that of the inactive turns and also being inserted (if need be) between different adjacent sections of the primary winding, but being in a strictly limited number, namely the number imposed by the transformation ratio.

In other words, such being the case, a transformer in accordance with the invention, in particular a dropping transformer with high welding current, may be further characterized in that it comprises, on the one hand, a number—depending on the desired transformation ratio—of active cooling turns forming the secondary circuit and, on the other hand, a number—depending on the degree of cooling required—of additional cooling turns or inactive electrically dead turns, having solely a cooling function and not forming part of the secondary circuit, all or part of the assembly of these active turns and additional turns dividing the winding of the primary circuit into sections.

The invention does not of course exclude any configuration and the winding of the primary circuit could for example be divided solely by the additional cooling turns, i.e. the inactive turns, whereas the active turns of the secondary circuit would be entirely inside (possibly outside) the divided primary winding.

As for the technological construction of these different cooling turns, whether they are active or inactive, it may be of any appropriate known type as has already been mentioned and for example in the form of laminated copper strips or lamellae placed edge to edge, with insertion of a flattened and brazed cooling fluid duct, or else drawn aluminium strips with a longitudinal central passage for this fluid etc.

The same applies—as for the numerous variations—in so far as the connection of the cooling circuit is concerned which may, depending on requirements, be formed, not only as far as the active turns but also the inactive turns are concerned, from a number of sections connected in series or in parallel, or else a mixture thereof, and connected to an adequate cooling fluid source (for example water).

BRIEF DESCRIPTION OF THE DRAWINGS

In any case, different embodiments of the invention, as well as certain details of construction, will now be described by way of examples which are in no wise limiting, with reference to the figures of the accompanying drawing in which:

FIG. 1 is a schematic view of a transformer constructed in accordance with the invention, in perspective with portions cut away and two sections taken through two perpendicular planes and showing more especially the cross section of the windings of the primary and of the secondary, on the one hand, and the terminals for connecting the different circuits on the other;

FIGS. 2 and 3 are views showing in cross section other possible arrangements of the windings.

DESCRIPTION OF THE PREFERRED EMBODIMENTS

Figure 4:
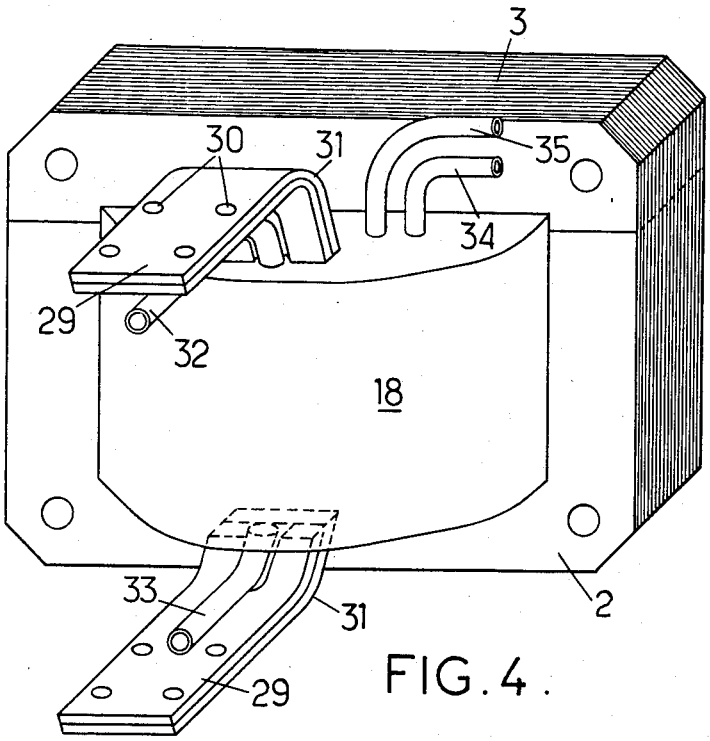
FIGS. 4 and 5 are perspective views, also schematic, showing the external appearance of two transformers constructed in accordance with the invention.

In FIG. 1 is shown a primary winding formed from a wire wound about the core 1 of an M shaped magnetic circuit 2 closed by a yoke 3, this winding being divided into three coaxial parts or sections 4*a*, 4*b* and 4*c*. Sections 4*b* and 4*c* are separated by the two active turns, themselves separated by an electric insulation 5, of a copper strip 6 wound coaxially on said core and forming the winding of the secondary circuit. As for sections 4*a* and 4*b*, they are separated by an additional inactive turn 7, serving solely for cooling this inner part of the primary, and also formed from a copper strip wound coaxially on the core.

In this example, it can be seen that the cross section of the inactive turn 7 is less than that of the active turn 6 since it has only a cooling function and since it does not have the current flowing therethrough.

These two copper strips 6 and 7 may be cooled by any appropriate means, for example by being each in the form of two laminated copper lamellae, respectively 6*a*–6*b* and 7*a*–7*b*, placed edge to edge, with insertion of brazed and flattened copper cooling ducts on the facing edges, and referenced respectively at 9 and 10, these ducts of course following, for the part thereof surrounding core 1, the same spiral path as the corresponding strips.

Generally, any appropriate construction may be adopted and among others those which are known from the French Pat. No. 1 068 283.

In this same FIG. 1, there are shown at 11 and 12 two copper blocks brazed to the output ends of the secondary winding 6 and serving, on the one hand, for establishing the electric connections to the external circuit to be connected to this winding, through tapped holes such as 13 and, on the other hand, for communicating ducts 9 and 10 (which have been shown in parallel) with an external cooling water source (not shown), said blocks comprising for this purpose water inlet and outlet openings, respectively 14 and 15.

As can be seen in the figure, the inlet ends of ducts 9 and 10 are both brazed to the connecting block 11 and similarly the other end of duct 9 is brazed to the connecting block 12, whereas the outlet end of duct 10, referenced at 16, is connected to this same block 12 through an insulating elbow connection 17, for example made from rubber so as to avoid any short circuiting of the secondary winding 6 by the water circuit 10 and the cooling turn 7 (see, at the bottom of FIG. 1, the part shown broken away from the lower connecting block 12). It should be mentioned here that the water circuits for cooling windings 6 and 7 may be connected to those generally provided for cooling each of the welding electrodes connected to the secondary of the transformer. The connections to blocks 11 and 12 may advantageously be provided by means of resilient sealing joints.

It should finally be noted, in so far as blocks 11 and 12 are concerned, that they will be preferably anchored in the polymerized synthetic resin used in coating the coils 18 of the windings and thereby preventing vibrations.

In FIGS. 2 and 3, are shown variations of the different arrangements of the primary and secondary windings, the construction of the different connections being moreover possibly of the same type as the one which has just been described with reference to FIG. 1.

In FIG. 2, the primary winding has been divided into four sections 19, the different separations being provided by a single central secondary circuit turn 20 and two inactive turns, one outer and the other inner, of an additional coaxial cooling winding 21. The respective cooling circuits 22 and 23 may be formed as in FIG. 1 (flattened copper tubes brazed to the facing edges of lamellae forming the different turns).

According to FIG. 3, the distribution of the different windings and winding sections is similar to that of FIG. 1, comprising three primary winding sections 24, with insertion of two turns, insulated from each other, of a secondary winding 25 (with a cooling duct also in spiral form 26), and of an inactive turn of an additional cooling winding 27. However, here the cooling fluid duct 28 for winding 27 is formed by two turns (connected in parallel or in series) spaced apart in the direction of the width of the strip, which may present, over the embodiment of FIG. 1, the advantage of a better distribution of the temperature over the width of the additional cooling winding.

Figure 5:
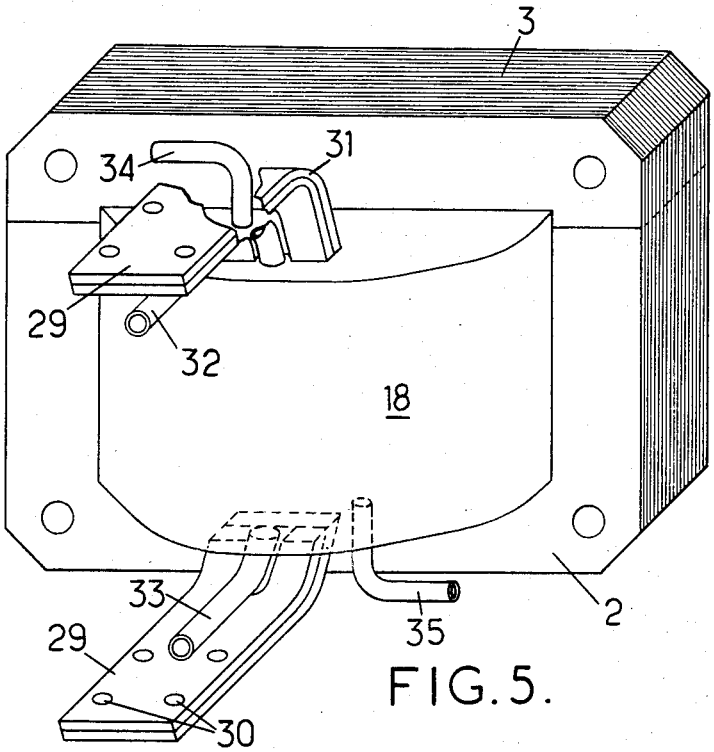

Finally, FIGS. 4 and 5 show two possible external appearances of transformers constructed in accordance with the invention, without using the connection blocks of FIG. 1 (independent outlets of the cooling circuits).

In these figures, there is shown at 29 the two output ends of the secondary winding, comprising holes 30 for connecting screws. These ends are formed by two strips joined face to face, which facilitates bending thereof at 31 towards the connection at the ends properly speaking of the winding. This connection (not shown in the figures) is provided as a miter and is fixed by brazing. There are further shown at 32 and 33 respectively the water inlet and outlet of the duct for cooling the secondary winding. For the magnetic circuit, the same references have been used as in FIG. 1.

Finally, it should be noted that, in the embodiment of FIG. 4, the inlet 34 and outlet 35 of the water duct for the additional cooling winding have been shown on the same side of coil 18, whereas in FIG. 5, by way of variation, they have been shown on the opposite sides of this coil.

One or the other configuration will be used, depending on the connection conditions (one end could also be provided on the other side of the magnetic circuit).

It will be noted that ends 32 to 35 have advantageously a circular section for facilitating external connections, whereas the cooling ducts are flattened inside, as mentioned above, so as to fill practically the whole of the space in rectangular section between the facing edges of the two lamellae of the same strip.

As is evident, and as it follows moreover already from what has gone before, the invention is in no wise limited to those of its modes of application and embodiments which have been more especially considered; it embraces, on the contrary, all variations thereof.

This is particularly true for the number and distribution of the different parts or sections of the primary winding, for the number and distribution of the so-called active turns forming the secondary winding, those of the so-called inactive turns forming the additional cooling winding, the materials used, sections and other dimensions of the magnetic and electric circuits, coupling and connection methods, embodiments of the different cooling circuits, applications contemplated and the like.

I claim:

1. A transformer comprising a primary circuit including a primary winding and a secondary circuit including a secondary winding, a first plurality of electrically active cooling turns forming at least part of the secondary winding of the secondary circuit, and the number of turns of said first plurality being dependent upon the transformation ratio of the transformer, said transformer further comprising a second plurality of electrically inactive cooling turns having a cooling liquid circulating therein provided in the winding of at least one of said circuits in thermal contact with that winding for serving solely a cooling function and not forming a part of said secondary circuit, the number of turns of said second plurality depending upon the cooling to be provided, means for enabling circulation of a cooling liquid through said second plurality of cooling turns, and at least a portion of said electrically active turns and said electrically inactive turns dividing the winding of the primary circuit into separate sections.

2. A transformer as claimed in claim 1 wherein said transformer comprises a voltage dropping transformer for an electric welding machine and wherein said secondary circuit comprises a wound strip.

3. A transformer as claimed in claim 2 wherein at least one cooling turn of said second plurality is provided in the winding of the secondary circuit.

4. A transformer as claimed in claim 2 wherein at least one cooling turn of said second plurality is provided in the windings of both the primary and secondary circuits.

5. A transformer as claimed in claim 1 wherein at least one cooling turn of said second plurality is provided in the winding of the primary circuit.

6. A transformer as claimed in claim 1 wherein said means for enabling circulation of a cooling liquid comprises first and second connecting blocks, connected electrically to the ends of the winding of the secondary circuit, for connecting the secondary circuit to an external electrical circuit to which current is to be supplied and for connecting the at least one cooling turn to a cooling liquid supply source.

7. A transformer as claimed in claim 1 in which the liquid for cooling the electrically active turns of the winding of the secondary circuit and the electrically inactive cooling turns flows in ducts in thermal and electrical contact with metal strips forming these turns.

8. A transformer as claimed in claim 7, wherein said ducts are brazed between the facing edges of two laminations forming the strips.

9. A transformer as claimed in claim 7, wherein the ends of said ducts are connected directly so as to be in electrical contact with a pair of connecting blocks, except for at least one of the ends of a duct for cooling an electrically inactive cooling turn, the last-mentioned duct being connected to a corresponding connecting block through an insulation sleeve, thereby preventing short-circuiting of the secondary winding.

10. A transformer as claimed in claim 9 wherein the connection between the connecting blocks and the ends of the windings of the secondary circuit and the ends, with one exception, of the cooling circuit is provided by brazing or welding, said blocks being further anchored in a polymerized synthethic resin coating for the coils of the windings.

* * * * *